US008608094B2

(12) United States Patent
Blatton et al.

(10) Patent No.: US 8,608,094 B2
(45) Date of Patent: Dec. 17, 2013

(54) TUBE MILL WITH INTERNAL LINING OF EPOXY MATERIAL

(75) Inventors: Gerhard Blatton, Beckum (DE); Hubert Grothaus, Bad Iburg (DE)

(73) Assignee: Polysius AG, Beckum (DE)

( * ) Notice: Subject to any disclaimer, the term of this patent is extended or adjusted under 35 U.S.C. 154(b) by 497 days.

(21) Appl. No.: 12/671,628

(22) PCT Filed: Aug. 5, 2008

(86) PCT No.: PCT/EP2008/060294

§ 371 (c)(1),
(2), (4) Date: Feb. 1, 2010

(87) PCT Pub. No.: WO2009/027187

PCT Pub. Date: Mar. 5, 2009

(65) Prior Publication Data

US 2011/0220747 A1 Sep. 15, 2011

(30) Foreign Application Priority Data

Aug. 29, 2007 (DE) ..... 10 2007 040 888

(51) Int. Cl.
*B02C 17/22* (2006.01)

(52) U.S. Cl.
USPC ..... 241/21; 241/182; 241/299

(58) Field of Classification Search
USPC ..... 241/21, 299, 300, 182, 183
See application file for complete search history.

(56) References Cited

U.S. PATENT DOCUMENTS

| | | | | | |
|---|---|---|---|---|---|
| 1,590,655 | A * | 6/1926 | Spicer | 241/182 |
| 3,378,209 | A * | 4/1968 | Crocheron | 241/102 |
| 3,869,091 | A * | 3/1975 | Enkegaard et al. | 241/183 |
| 3,913,851 | A * | 10/1975 | Andersson | 241/300 |
| 4,205,500 | A | 6/1980 | Hensley et al. | |
| 4,341,355 | A * | 7/1982 | Hornberger | 241/102 |
| 4,613,084 | A * | 9/1986 | Takamoto et al. | 241/16 |
| 4,848,681 | A * | 7/1989 | Eriksson et al. | 241/183 |
| 4,926,601 | A * | 5/1990 | Musschoot | 451/113 |
| 5,360,174 | A * | 11/1994 | Persson | 241/183 |
| 5,690,285 | A * | 11/1997 | Brisbois | 241/172 |
| 5,752,665 | A | 5/1998 | Wason | |
| 5,839,490 | A * | 11/1998 | Kiedaisch et al. | 144/208.9 |
| 6,189,280 | B1 * | 2/2001 | Malmberg | 52/506.05 |
| 7,887,000 | B2 * | 2/2011 | Siitonen et al. | 241/183 |
| 2006/0113416 | A1 * | 6/2006 | Tirschler | 241/299 |

FOREIGN PATENT DOCUMENTS

| | | |
|---|---|---|
| DE | 1287423 B | 1/1969 |
| FR | 2196591 A5 | 3/1974 |

* cited by examiner

*Primary Examiner* — Mark Rosenbaum
(74) *Attorney, Agent, or Firm* — Gifford, Krass, Sprinkle, Anderson & Citkowski, P.C.

(57) ABSTRACT

A tube mill for wet-grinding of lumpy material. The tube mill can have a mill cylinder, an inlet opening for charging the lumpy material, a means for adding an aggressive medium and a discharge opening. In addition, the mill cylinder can have an internal lining of epoxy material and the means for adding an acid to the lumpy material in the region of the inlet opening.

15 Claims, 1 Drawing Sheet

FIG. 1
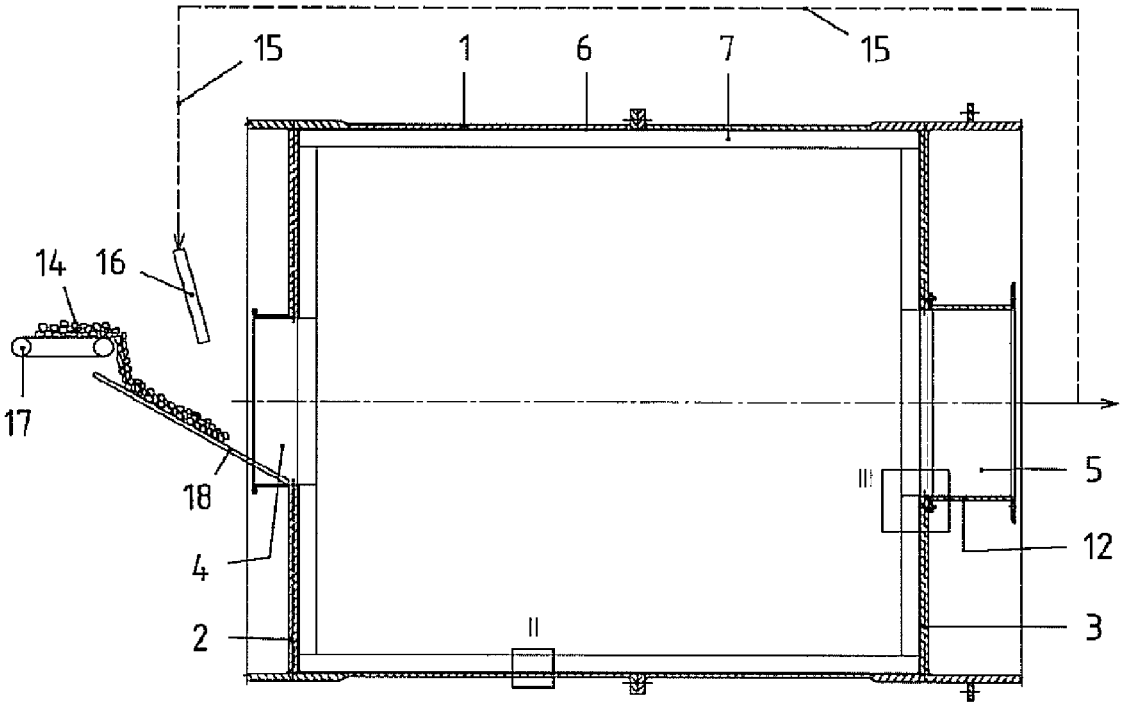
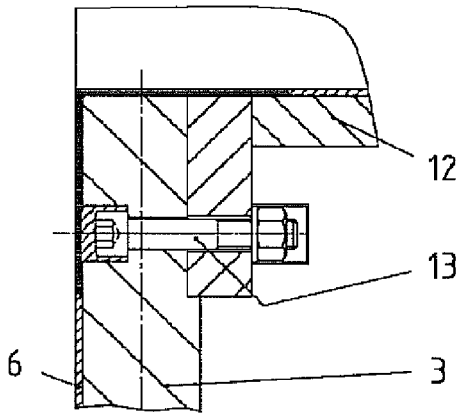
FIG. 3
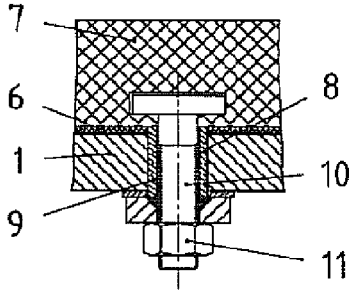
FIG. 2

TUBE MILL WITH INTERNAL LINING OF EPOXY MATERIAL

FIELD OF THE INVENTION

The invention relates to a tube mill for wet-grinding of lumpy material.

BACKGROUND OF THE INVENTION

Grinding operations in tube mills using the wet method are generally known in practice. When grinding ore material, an acid treatment operation is additionally necessary, the acid generally being added after the grinding operation and then having to be neutralised after the acid treatment operation. However, this is relatively complex and costly. It would therefore be very desirable for the acid to be able to be recirculated.

Tube mills which are generally used are, however, not designed for a grinding operation with an acid owing to the problem of corrosion of the mill cylinder. Therefore, it has already been considered to produce the mill cylinder from high-grade steel, which would, however, be linked with enormous additional costs.

SUMMARY OF THE INVENTION

The object of the invention is therefore to provide a tube mill which is suitable for grinding lumpy material with an acid and can be produced in a significantly more cost-effective manner compared with a high-grade steel solution.

The tube mill according to the invention for wet-grinding of lumpy material substantially has a mill cylinder, an inlet opening for charging the lumpy material, means for adding an aggressive medium and a discharge opening, an internal lining of epoxy material being provided in the mill cylinder.

Such an internal lining provides adequate protection of the mill cylinder against an aggressive medium which is to be used, such as, for example, an acid. If the mill cylinder were unprotected, the corrosion would be up to one mm per hour and would destroy the mill cylinder within an extremely short period of time. Grinding balls containing high-grade chromium are further used in the tube mill.

The acid-resistant epoxy material further also provides protection against wear to the mill cylinder.

Owing to such an internal lining, a conventional mill cylinder of simple steel can be used.

The dependent claims relate to further configurations of the invention.

According to a preferred configuration of the invention, the internal lining comprises a plurality of layers, it being possible to provide, for example, a first barrier layer formed by an adhesive-bonding agent/primer and a second barrier layer comprising an epoxy material. An epoxy resin material can be used in particular as an epoxy material.

According to a preferred configuration of the invention, a "polymer composite" which is an epoxy matrix having a high proportion of filling materials (from 60 to 90% by weight) is used as an epoxy material. Silicone carbide, aluminia and/or aluminium oxide are particularly used as filling materials. The filling material size for the adhesive-bonding agent/primer is in the range of from 10 to 50 μm and is up to 1600 μm for the second barrier layer. In the second barrier layer, it is also possible to incorporate an elastomer, whereby the impact toughness is increased.

Furthermore, the internal lining may contain materials such as rubber, fibres and aluminium carbides in order to make it more resistant to wear and more durable. It is further conceivable for the internal lining to be at least partially reinforced with a woven material, for example, glass fibres or carbon fibres.

It is further possible to provide, at the inwardly facing side of the internal lining, an additional layer for protection against wear which is formed, for example, by means of a rubber or steel cladding. When a steel cladding is used, it is possible to use a conventional steel cladding since the wear of the steel cladding caused by corrosion is significantly less than the wear caused by grinding and consequently the additional corrosion-related wear can be taken into account.

In order to screw the wear protection layer, the mill cylinder has through-holes, the through-holes advantageously being lined with sleeves which are arranged so as to be electrically insulated with respect to the mill cylinder or comprise an electrically non-conductive material so that electrical corrosion caused by the use of different steels can be prevented.

In the method according to the invention for wet-grinding of lumpy material, the tube mill described above is used. The lumpy material can be ground, in particular with the addition of an aggressive medium, in particular an acid. The lumpy material may be, for example, an ore material.

BRIEF DESCRIPTION OF THE DRAWINGS

If the lumpy material is ground together with the aggressive medium in the tube mill, it is possible to recirculate the aggressive medium, with it being separated from the ore material after treatment thereof and being guided back to the tube mill.

Further advantages and configurations of the invention will be explained in greater detail below with reference to the description and the drawings, in which:

FIG. 1 is a schematic cross-section of a tube mill,

FIG. 2 is an illustration of the detail II of FIG. 1 and

FIG. 3 is an illustration of the detail III in FIG. 1.

DETAILED DESCRIPTION OF THE INVENTION

The tube mill illustrated in FIG. 1 for wet-grinding of lumpy material 14 has a mill cylinder 1, an inlet-side end wall 2 and an outlet-side end wall 3. Furthermore, an inlet opening 4 is provided in the end wall 2 and a discharge opening 5 in the end wall 3. The material 14 to be ground, for example, copper ore, is discharged directly from a conveyor belt 17 into an inlet 18 of the tube mill. There are further provided means 16 for adding a fluid aggressive medium, in particular an acid, which are formed, for example, by means of a pipeline and are arranged in the region of the inlet 18. The fluid is consequently added to the material 14 in the region of the inlet 18 and thereby ensures problem-free introduction into the tube mill.

The mill cylinder 1 further has an internal lining 6 of epoxy material, the internal lining being able to be constructed as one layer or multiple layers. It is thus possible in particular to provide a first barrier layer formed by an adhesive-bonding agent/primer and a second barrier layer comprising an epoxy material. The epoxy material is preferably an epoxy resin material which may contain additional components, such as rubber, fibres and/or aluminium carbides.

At the inwardly-facing side of the internal lining, an additional wear protection layer 7 is further provided which may be formed by a rubber or steel cladding. Even when the additional wear protection layer is damaged by the impact of balls or grinding material, adequate wear protection is still provided by the epoxy material used with a high proportion of highly wear-resistant filler materials.

The wear protection layer is composed in conventional manner from individual plates which are screwed to the mill cylinder. As can be seen in FIG. 2, the mill cylinder 1 has, for screwing the wear protection layer 7, through-holes 8 which are lined with sleeves 9.

In order to ensure adequate corrosion protection in this region, the sleeves must, on the one hand, comprise a material which is resistant with respect to the aggressive medium to be used (acid) and, on the other hand, does not lead to electrical corrosion owing to the differing materials of the sleeve 9 and mill cylinder 1. The sleeves are therefore advantageously arranged so as to be electrically insulated with respect to the mill cylinder or comprise an electrically non-conductive material. Furthermore, the sleeves must be resistant with respect to the aggressive medium to be used. For example, high-grade steel sleeves may be considered. The sleeves 9 can be secured, in particular by means of adhesive-bonding.

In order to secure the wear protection layer or the individual plates of the wear protection layer, screws 10 and nuts 11 are used.

In addition to these through-holes 8, specific means are further provided in the region of the inlet opening 4 and the discharge opening 5.

FIG. 3 is a detailed view in the region of the discharge flange 12 which is screwed to the discharge-side end wall 3 by means of screws 13. In the region of the edge formed by the end wall 3 and the discharge flange 12 the internal lining 6 should advantageously be reinforced by a woven material (for example, of glass fibres and/or carbon fibres).

With a tube mill of this type, it is possible to add an aggressive medium 15, in particular an acid, when grinding lumpy material 14, for example, ore material. After grinding the lumpy material 14 and optionally additional treatment with the aggressive medium 15, the aggressive medium 15 is separated from the treated material and guided back to the inlet of the tube mill. It is consequently possible to recirculate the aggressive medium 15, as indicated by the broken line in FIG. 1.

It is thereby possible to dispense with intermediate neutralisation of the aggressive medium, whereby additional aggregates and neutralisation agents can be saved. The internal lining described of epoxy material also has the advantage that it can be readily repaired in the event of any damage. The internal lining further does not only act as a reliable protection for the mill cylinder with respect to an aggressive medium, but also provides, in particular owing to additional additives, such as aluminium carbide, additional wear protection of the mill cylinder 1 which is in particular used when gaps are formed between the plates of the wear protection layer 7 or the wear protection layer becomes damaged.

The invention claimed is:

1. A tube mill for wet-grinding of lumpy material (14) having a mill cylinder (1), an inlet opening (4) for charging the lumpy material, means (16) for adding an acid and a discharge opening (5), characterized in that the mill cylinder has an internal lining (6) of epoxy material and the means for adding the acid arranged such the acid is added to the lumpy material in the region of the inlet opening (18).

2. The tube mill according to claim 1, characterized in that the internal lining (6) has at least a first barrier layer formed by an adhesive-bonding agent and a second barrier layer comprising an epoxy material.

3. The tube mill according to claim 1, characterized in that the epoxy material contains from 60 to 90% of highly wear-resistant filler materials.

4. The tube mill according to claim 1, characterized in that the epoxy material is an epoxy resin material.

5. The tube mill according to claim 1, characterized in that the internal lining (6) contains aluminium carbides.

6. The tube mill according to claim 1, characterized in that the internal lining (6) contains rubber.

7. The tube mill according to claim 1, characterized in that the internal lining (6) contains fibres.

8. The tube mill according to claim 1, characterized in that the internal lining (6) is at least partially reinforced with a woven fabric.

9. The tube mill according to claim 1, characterized in that, at the inwardly facing side of the internal lining (6), an additional wear protection layer (7) is provided.

10. The tube mill according to claim 9, characterized in that the wear protection layer (7) is formed by a rubber or steel cladding.

11. The tube mill according to claim 9, characterized in that the mill cylinder (1) has through-holes (8) for screwing the wear protection layer (7), the through-holes (8) being lined with sleeves (9) which are arranged so as to be electrically insulated with respect to the mill cylinder (1) or comprise an electrically non-conductive material.

12. A method for wet-grinding lumpy material comprising the steps of:

forming an internal lining of epoxy material on a mill cylinder;

charging the lumpy material through an inlet opening in the mill cylinder;

adding an acid to the lumpy material;

grinding the lumpy material in the presence of the acid; and discharging processed material through an outlet opening.

13. The method according to claim 12, characterized in that the lumpy material (14) is an ore material.

14. The method according to claim 12, characterized in that acid (15) is recirculated.

15. The method according to claim 12 characterized in that the acid is added to the lumpy material in the region of an inlet to the tube mill.

* * * * *